US007213988B2

(12) United States Patent
Takahashi

(10) Patent No.: US 7,213,988 B2
(45) Date of Patent: May 8, 2007

(54) IMAGE FORMING DEVICE

(75) Inventor: Shigeyuki Takahashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/187,040

(22) Filed: Jul. 22, 2005

(65) Prior Publication Data

US 2006/0018697 A1 Jan. 26, 2006

(30) Foreign Application Priority Data

Jul. 23, 2004 (JP) ..... 2004-215934
Jun. 30, 2005 (JP) ..... 2005-190833

(51) Int. Cl.
*B41J 11/44* (2006.01)

(52) U.S. Cl. ..... 400/76; 400/61; 399/401

(58) Field of Classification Search ..... 400/61, 400/62, 70, 76, 624; 399/401, 402; 271/186
See application file for complete search history.

(56) References Cited

U.S. PATENT DOCUMENTS 4,853,740 A * 8/1989 Ushio et al. ..... 399/402
5,700,003 A * 12/1997 Sung ..... 271/110

FOREIGN PATENT DOCUMENTS

| | | | |
|---|---|---|---|
| JP | 8-91643 A | | 4/1996 |
| JP | 08091643 A | * | 4/1996 |
| JP | 09218547 A | * | 8/1997 |
| JP | 2000-255113 A | | 9/2000 |
| JP | 2000-289259 A | | 10/2000 |

* cited by examiner

*Primary Examiner*—Minh Chau
(74) *Attorney, Agent, or Firm*—Sughrue Mion, PLLC

(57) ABSTRACT

An image forming device is provided in which erroneous printing on a sheet of paper rather than the rear surface of the desired paper during manual double-side printing can be prevented. An image forming device for executing manual double-side printing in which a user sets a paper sheet when printing is conducted on the other side of the paper sheet after printing on one side of the paper sheet, comprising at least one paper feed unit which feeds paper sheets, a control unit which instructs to feed paper from one of the paper feed units that was preset for printing on the other side when printing on the other side of the paper sheet, and a printing unit which carries out the paper feed from the preset paper feed unit, according to the paper feed instruction, and executes the printing of the other side on the paper sheet.

2 Claims, 4 Drawing Sheets

IMAGE FORMING DEVICE

CROSS-REFERENCE TO RELATED APPLICATIONS

This application is based upon and claims the benefit of priority from the prior Japanese Patent Application No. 2004-215934, filed on Jul. 23, 2004, and the prior Japanese Patent Application No. 2005-190833, filed on Jun. 30, 2005, the entire contents of which are incorporated herein by reference.

BACKGROUND OF THE INVENTION

1. Field of the Invention

The present invention relates to an image forming device in which printing can be conducted on both sides of paper sheets, more particularly to an image forming device in which erroneous printing on a sheet of paper rather than the rear surface of the desired paper during manual double-side printing can be prevented.

2. Description of the Related Art

Double-side printing on paper has been conducted in image forming devices such as printers and copiers with the object of saving paper. Such double-side printing in image forming devices is conducted in the so-called automatic double-side printing mode, in which handling of paper sheets is conducted automatically, and the so-called manual double-side printing mode, in which a paper sheet that was printed on one side is manually reset in the image forming device. In the automatic double-side printing, the paper sheets have to be turned over mechanically and a mechanism designed therefor is provided. Furthermore, because the paper transportation path is extended, a mechanism for oblique passage correction is also required. Therefore, though such a system has a merit of automation, the demerits thereof include enlarged size, complex mechanisms, and increased cost. On the other hand, the manual double-side printing does not require special mechanisms, but the printing obviously has to involve manual operations. Furthermore, the user has to be careful to avoid confusing the direction of paper sheets which are set during printing.

Accordingly various suggestions have been made to improve the manual double-side printing. For example, Japanese Patent Application Laid-open No. 2000-289259 describes a technology comprising the steps of determining the orientation of paper sheets by detecting the discrimination marks, which were recorded on the paper sheets, during double side printing and executing the double-side printing after setting the appropriate image orientation.

On the other hand, some image forming devices such as printers have a plurality of paper feed means and in which paper sheets of a plurality of types are set at the same time, in order to avoid replacing a paper feed cassette and setting the paper sheets on the paper feed tray, when printing is conducted on paper of different types and sizes. In such devices, a paper feed unit having set therein the paper sheets matching the type of paper sheets designated by an application or printer driver is automatically selected and printing is executed by feeding the paper therefrom, unless a special designation is provided during printing. In such a case, when no paper is present in the selected paper feed unit, the image forming device is most often controlled so as to select a paper feed unit based on a priority order of the paper feed units set in the image forming device.

In the above-described conventional image forming devices having a plurality of paper feed units, no special consideration is usually given to controlling the feed unit from which paper is fed to the above-described manual double-side printing. Therefore, there is a risk that paper feed will be automatically started from a paper feed unit where paper sheets are present prior to setting manually the paper sheet that is necessary during rear-side printing (second pass printing) of the manual double side printing and that the data to be printed on the rear side will be printed on a wrong paper sheet.

Furthermore when the paper sheets are consumed in the course of rear-side (second pass) printing, for example, in the case where all the paper sheets cannot be set at once into a paper feed tray when large volume printing is carried out in a manual double-side printing mode, there is also a risk that paper will be automatically fed from another paper feed unit to continue printing on the rear side before the paper remaining after the front-side printing is replenished. If such wrong paper is fed, the so-called paper jam can sometimes occur when paper sheets of different type are fed.

SUMMARY OF THE INVENTION

Accordingly, it is an object of the present invention to provide an image forming device in which printing can be carried out without confusing the paper sheets of the rear side when double-side printing is carried out manually.

In order to attain the above-described object, the present invention in accordance with one aspect thereof provides an image forming device for executing manual double-side printing in which a user sets a paper sheet when printing is conducted on the other side of said paper sheet after printing on one side of said paper sheet is completed, comprising at least one paper feed unit which feeds paper sheets, a control unit which instructs to feed paper from one of said paper feed units that is preset for printing on said other side when printing on the other side of said paper sheet is carried out, and a printing unit which carries out the paper feed from said preset paper feed unit, according to said paper feed instruction, and executes said printing of the other side on said paper sheet that is fed. As a result, automatic feeding from the other paper feed unit that has incorrect paper sheets set therein and erroneous printing on a sheet of paper rather than the rear surface of the desired paper during manual double-side printing can be prevented.

Furthermore, in the preferred embodiment, the above-described image forming device in accordance with the present invention further comprises a paper sheet presence detection unit which detects the presence of paper sheets in said preset paper feed unit, and a display unit which displays messages for a user of said image forming device, wherein when the printing is conducted on the other side of said paper sheet, in the case where said paper sheet presence detection unit detects the presence of a paper sheet, said control unit issues said paper feed instruction, and in the case where said paper sheet presence detection unit detects that the paper sheet is absent, said control unit instructs said display unit to display a message suggesting to set said paper sheet into said preset paper feed unit. As a result, the processing is prevented from remaining in the interrupted state due to extended lack of paper feed during rear-side printing. Furthermore, the risk of another user setting an incorrect paper sheet into the paper feed unit used during rear-side printing and conducting rear-side printing on the incorrect paper sheet before the user of the manual double-side printing sets the correct paper sheet for the rear side is reduced.

Other object and features of the present invention will become clear from the embodiments of the present invention explained hereinbelow.

BRIEF DESCRIPTION OF THE DRAWINGS

FIGS. 4A–4D illustrate examples of the messages displayed on the operation unit 7 or the like.

DESCRIPTION OF THE PREFERRED EMBODIMENTS

Figure 1:
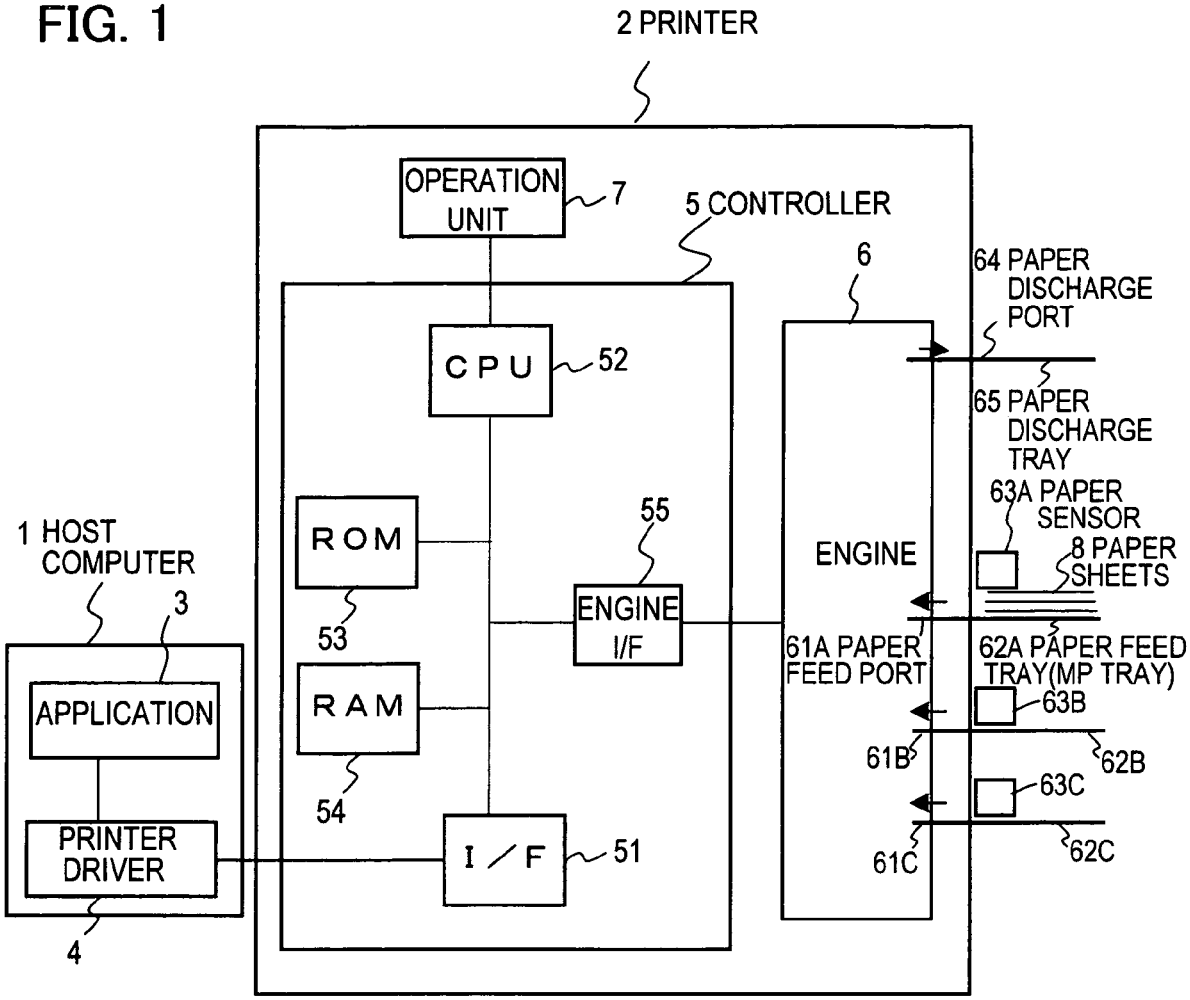
FIG. 1 is a structural drawings relating to the embodiments of the image forming device employing the present invention.

The embodiments of the present invention will be described below with reference to the appended drawings. However, those embodiments place no limitation on the technological scope of the present invention. In the figures, the identical or similar components are assigned with identical reference numerals or reference symbols.

FIG. 1 illustrates the structure of the embodiment of a printer which is an image forming device employing the present invention. A printer 2 shown in FIG. 1 is an image forming device employing the present invention and serves to form images on a prescribed printing medium (paper sheets 8) based, e.g., on a printing request from a host computer 1. In this printer 2, when manual double-side printing is conducted, the paper feed unit used during rear-side printing is fixed and correct double-side printing is conducted without confusing the paper sheets.

The host computer 1 shown in FIG. 1 is a host device sending a printing request to the printer 2. This device sends printing data of the printing object to the printer 2 based on the user's operations. The host computer 1 can comprise the so-called personal computer. An application 3 located in the host computer 1 is a printing request source for the printer 2. The user sending a printing requests opens a printing setting screen of a printer driver 4 from the application 3, displays the printing setting screen on the host computer, and carries out the setting of various conditions relating to printing. Therefore, even when the user wishes to conduct manual double-side printing, a request to this effect is sent from the application 3.

Furthermore, the printer driver 4 is what receives data from the application 3 and generates the aforementioned printing data which are to be sent to the printer 2. The printing data comprise image data, which are the data representing the image that is to be printed, and a control command indicating various conditions relating to printing. In the case of a manual double-side printing, the number of pages of manual double-side printing in the requested printing job is contained in the printing data. Furthermore, each image data relating to the front surface and rear surface is sent from the printer driver 4 to the printer 2 in the prescribed order suited for manual double-side printing.

For example, in the case where four pages are manually double-side printed, the image data are sent in the order of the fourth page, second page, first page, and third page. Accordingly, in the printer 2, first, the fourth page and second page are printed on respective one side of two paper sheets 8 and then the first page and third page are printed on the opposite sides of the two paper sheets 8. The printing processing relating to the side where the printing is initially conducted in such double-side printing (in the above-described example, printing of the fourth page and second page) will be referred to as first-pass printing, and the printing processing in which printing is then conducted (in the above-described example, printing of the first page and third page) will be referred to as second-pass printing.

The printer driver 4 executes the processing of converting the image data represented by PDL described for each object into the image data represented by density values for each pixel, the processing of converting the color representation of the image data after the above-described conversion into color representation during printing with the printer 2, and the processing of subsequently compressing the data. Thus, in the present embodiment, the so-called host-base system is assumed. Furthermore, the printer driver 4 is a program for executing the processing relating to the above-described functions in a host computer 1, and those functions are realized by a control unit (not shown in the figure) of the host computer 1 executing the processing according to this program.

The printer 2 is the so-called four-cycle laser printer that receives the printing data sent from the host computer 1 and executes the printing in the page units. As shown in FIG. 1, this printer comprises a controller 5, an engine 6, and an operation unit 7. The controller 5 comprises an I/F 51, a CPU 52, a ROM 53, a RAM 54, and an engine I/F 55.

The I/F 51 is a unit for receiving the printing data sent from the host computer 1. The ROM 53 is a unit for storing various programs for controlling the printer 2. RAM 54 is a memory for storing the received printing data, and the image data for each page that will be printing processed with the engine 6 are transferred herefrom to an engine I/F 55.

The CPU 52 is a unit for controlling various processing operations carried out in the printer 2. In particular, it controls the processing of storing the image data contained in the received printing data in the RAM 54, the processing of interpreting the control command contained in the printing data and designating the printing processing adequate for the engine 6, and the processing of controlling the operation unit 7 for forming the interfaces with the user. The specific feature of this printer 2 is in the contents of those processing operations implemented when a request for manual double-side printing is received from the host computer 1. This specific contents will be described below. The processing executed by the CPU 52 is mainly carried out following the program stored in the ROM 53.

Furthermore, the engine I/F 55 is a unit providing for interface between the controller 5 and engine 6, this unit reading the pixel data stored in the aforementioned RAM 54 at the prescribed timing when printing is executed with the engine 6, subjecting the pixel data to the prescribed processing, and then transferring them to the engine 6. This engine I/F 55 comprises a memory for temporarily storing the data, a decompression unit, and a screen processing unit (none of them is shown in the figures) for conducting decompression of compressed pixel data read out from the RAM 54 and screen processing for converting the decompressed data into dot data. More specifically, the engine I/F 55 is composed of ASIC.

The units of the above-described controller 5 are connected to each other so that they exchange data.

The engine 6 is a unit for executing the printing processing based on the data outputted from the engine I/F 55 and forming an image on a printing medium such as paper 8. This engine 6, similarly to the usual laser printers, comprises a charging unit, an exposure unit, a developing unit, and a transfer unit (none of them is shown in the figure). At the very last stage of the printing processing, a transfer operation from a transfer unit is conducted on paper sheets 8 supplied via a paper feed port 61 from a paper feed tray 62, fixing processing is conducted with a fixing unit (not shown in the figure), and the paper sheets 8 subjected to printing are discharged to a paper discharge tray 65 via a paper discharge port 64.

In the printer 2 three paper feed ports 61A to 61C and three paper feed trays 62A to 62C corresponding thereto are provided as paper feed units on the paper feed side. Furthermore, a paper feed cassette may be provided as the paper feed unit (such a configuration is not shown in the figure). A MP tray (Multi Purpose tray: a tray suitable for setting paper of any type on which printing can be conducted in the printer 2) is attached to the paper feed port 61A of the aforementioned three ports. Thus, the printer 2 is provided with a plurality of paper feed units, but in the second-pass printing of manual double-side printing, paper feeding is limited to the paper feed port 61A and paper feed tray 62A (MP tray). Furthermore, as shown in FIG. 1, paper sensors 63A to 63C for detecting the presence of paper in the trays are provided for corresponding paper feed trays 62.

The operation unit 7 is a unit employed by the user to operate the printer 2. This unit comprises a display panel 71 and a variety of operation buttons. A variety of setting operations such as setting of printing conditions in the printer 2 can be conducted in the operation unit 7. In addition, this unit is used for issuing a printing execution command or displaying messages during manual double-side printing.

The operation of the printer 2 of the present embodiment, which has the above-described configuration, will be described below. As mentioned hereinabove, the specific feature of the printer 2 is in the processing executed during manual double-side printing. Therefore, the processing contents relating to manual double-side printing will be explained. First, if a printing request relating to manual double-side printing is issued by the host computer 1, the printing data relating to the printing request is received by the I/F 55. The control command contained in the received printing data is sent to the CPU 52 and interpreted and various printing conditions relating to the printing job are determined. At this time, the number of pages for manual double-side printing of this printing job that is contained in the printing data is also clarified and because this number of pages is not zero, the CPU 52 makes a decision that this printing job is manual double-side printing and conducts the below-described control for manual double-side printing during printing processing in the engine 6. Furthermore, the image data for each page contained in the received printing data are sequentially stored in the RAM 54 and held in the RAM 54 till the prescribed timing at which the printing processing in the engine 6 is started.

For example, when a request for manual double-side printing of four pages is received from the host computer 1, the information indicating that the number of pages in the manual double-side printing of this printing job is four is contained in the received printing data. Therefore, the CPU 52 makes a decision that the current printing is manual double-side printing. Furthermore, because, the image data for four pages are sent in the order suitable for manual double-side printing, the image data are sequentially stored in the RAM 54 in this order. For example, as described hereinabove, the image data are stored in the order of fourth page, second page, first page, and third page.

The pre-processing in the printer 2, that is, the processing of receiving and storing the printing data is thus conducted, but in the middle of this pre-processing or thereafter, the post-processing, that is, the printing processing on the paper 8 based on the received data, is conducted in the printer 2. Such a post-processing is started at the prescribed timing based on the state of image data reception or engine 6 and conducted for each page. The main specific feature of the printer 2 is in the processing contents of the CPU 52 in this post-processing and the specific contents will be described hereinbelow.

Figure 2:
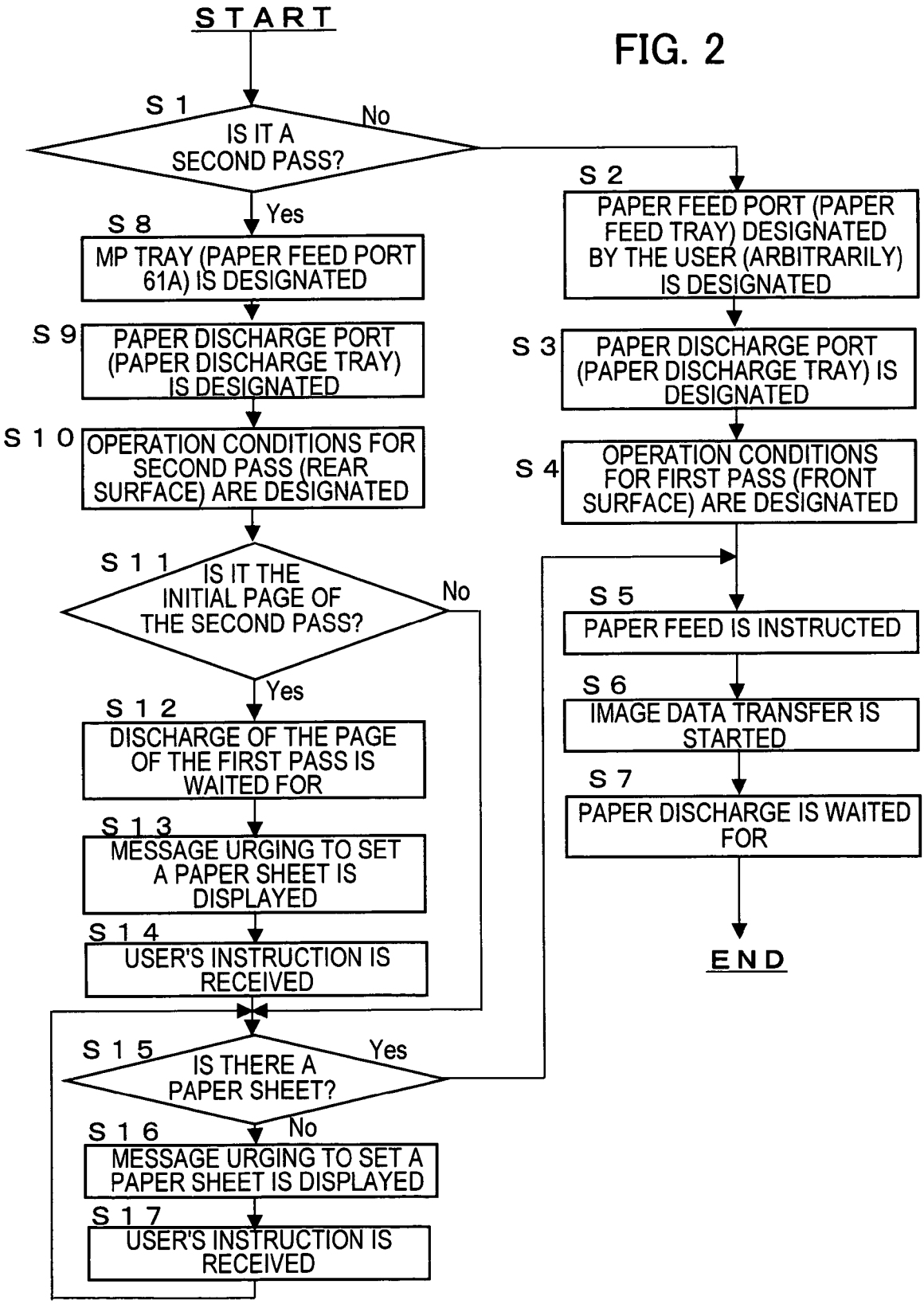
FIG. 2 is a flowchart illustrating the contents of the processing executed by the CPU 52 during last-stage processing.

FIG. 2 is a flowchart illustrating the contents of the processing relating to one page that is conducted by the CPU 52 during post-processing. First, at the timing allowing for printing processing with respect to a printing processing object page of the printing job in requested manual double-side printing, the CPU 52 makes a decision whether or not this page is a second pass of manual double-side printing (step S1). This decision is made according to a rule established in advance based, e.g., on the information relating to the number of the object page in the processing sequence of the requested printing job or an original page number.

When the result of this decision indicates not the second pass (No in step S1), that is, the first pass, the CPU 52 designates the paper feed port 61 (paper feed tray 62) to the engine 6 (step S2). Because the printer 2 employs a plurality of paper feed units, the CPU 52 designates the paper feed unit designated by the user, or when the user has designated the automatic paper feed selection by printing settings in the printer driver 4, the CPU 52 can sequentially examine the types of paper set in each paper feed unit and can designate the paper feed unit matching the paper type set for the printing job. Then, the CPU 52 designates the paper discharge port 64 (paper discharge tray 65) to the engine 6 (step S3). Because only one paper discharge port 64 and one paper discharge tray 65 are provided in the printer 2, the paper discharge port 64 and paper discharge tray 65 are designated.

Then, the CPU 52 sends an instruction relating to operating conditions for the first pass to the engine 6 (step S4). Here, the operating conditions mean various conditions relating to printing processing, such as transfer voltage. Usually, the operating conditions identical to those of single-side printing are instructed for the first pass. The CPU 52 thereafter instructs engine 6 to conduct paper feed (step S5) and starts transferring image data of the page to the engine 6 (stage S6). More specifically, the image data stored in the RAM 54 are read sequentially and transferred to the engine 6 after undergoing the prescribed processing in the engine I/F 55.

In the engine 6, printing processing on the paper 8 that was fed is executed based on the transferred image data. The CPU 52 waits till this printing processing is completed and the paper 8 with the image printed thereon is discharged (step S7). The processing conducted by the CPU 52 with respect to one page is thus completed.

When the above-described request for manual double-side printing on four pages is received, the processing for each page of the fourth page and second page, which is the first pass, is conducted following the contents of the above-described steps S2 to S7.

On the other hand, when the second pass is determined in the step S1 (Yes in step S1), the processing shifts to step S8, and the CPU 52 designates the paper feed port 61A as the paper feed port, that is, designates the MP tray 62A as the paper feed tray (step S8). Thus fixing the paper feed port 61 (paper feed tray 62) to the prescribed location in the second pass of manual double-side printing is an important specific feature of this printer 2. In the example of manual double-side printing on four pages, the second-pass processing is conducted with respect to the first page and third page.

Then, the CPU 52 designates the paper discharge port 64 (paper discharge tray 65) to the engine 6 (step S9). Because only one paper discharge port 64 and one paper discharge tray 65 are used in the printer 2, those paper discharge port 64 and paper discharge tray 65 are designated. Then, the CPU 52 designates the operating conditions for the second pass to the engine 6 (step S10). In this second pass, printing processing is conducted with respect to the paper 8, which has already been printed on one side. Therefore, the processing has to be conducted under operating conditions different from those of the first pass. Therefore, for example, a transfer voltage different from that of the first pass is designated.

The processing is thereafter divided depending on whether or not the page is the initial page of the second pass in the printing job of the manual double-side printing (step S11). When the page is the initial page of the second pass immediately following the completion of the first-pass processing (Yes in step S11), the CPU 52 waits till the printing processing described hereinabove with respect to the pages of the first pass is completed and the paper is discharged (step S12). Thus, it waits till all the printing is completed for the first pass and all the paper sheets 8 relating to the manual double-side printing are discharged to the paper discharge tray 65. In the example of manual double-side printing on four pages, when the first page is the initial page of the second pass, a transition is made to the processing of step S12 and the CPU waits till the fourth page and second page of the first pass are discharged.

When the discharge of paper sheets of the first pass is completed, the CPU 52 instructs the operation unit 7 to display a message urging the user to set the paper sheet 8 of the second pass and to conduct the second-pass printing (step S13). FIG. 4 illustrates an example of the message displayed on the operation unit 7 and host computer 1 by this according to this instruction. In the example shown in FIG. 4A, a "Manual Double Side" message is displayed on the display panel 71 of the operation unit 7, the user reconfirms that the manual double-side printing is conducted, and then recognizes the timing for setting the paper sheet 8 for the second pass into the MP tray 62A following the procedure relating to manual double-side printing that is described the manual (Operation Manual) of the printer 2, and then conducting the operation of pushing a "Printing Allowed" switch provided on the operation unit 7. Furthermore, in the example shown in FIG. 4B, because a "Please Set a Paper Sheet and Push the Switch" message is displayed on the display panel 71, the user recognizes the timing for setting the paper sheet 8 for the second pass into the MP tray 62A and pushing the "Printing Allowed" switch in accordance with this message.

Figure 4A:
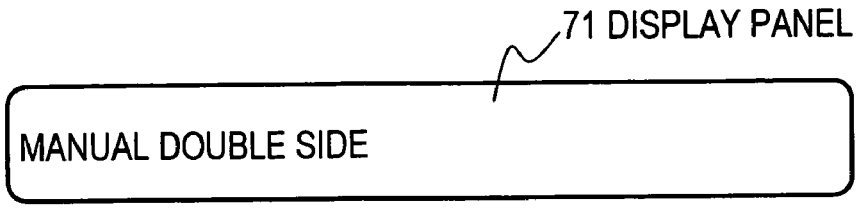
Figure 4B:
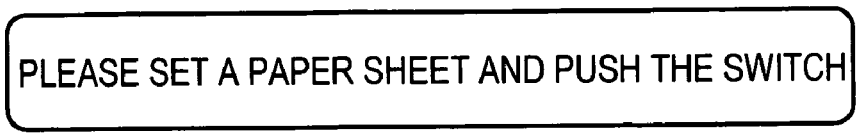
Figure 4C:
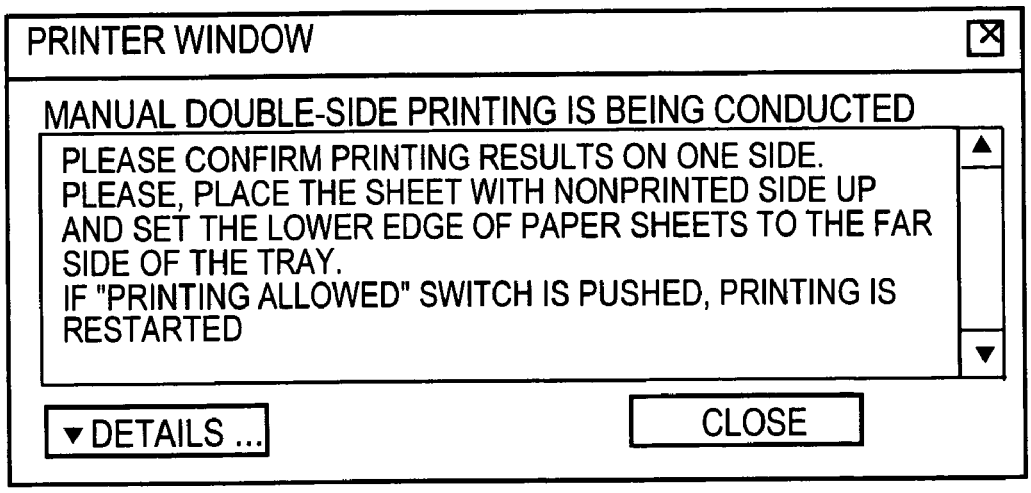

The display of the message in step S13 may be also conducted on the host computer 1. Thus, the message is designated to be displayed on the display unit (not shown in the figure) provided in the host computer 1. FIG. 4C shows an example of the message displayed on the host computer 1. The host computer 1 usually has a wide display area. Therefore, as shown in the figure, the message displayed on the host computer can be more polite than that displayed on the operation unit 7. This message urges the user at the host computer 1 side to set the paper sheet 8 of the second pass and push the "Printing Allowed" switch. The display (S13) of this message may be also conducted on both the operation unit 7 and the host computer 1.

If the message is thus displayed, the user sets the paper sheets 8, which went through the first-pass printing and were discharged into the paper discharge tray 65, with the prescribed orientation into the MP tray 62A and then pushes the "Printing Allowed" switch of the operation unit 7. Thus, the instruction is issued to the effect that the second-pass printing processing may be conducted. In the example where the manual double-side printing of four pages is conducted, the two paper sheets 8 in which printing of the fourth page and second page was completed are taken out from the paper discharge tray 65 and set into the MP tray 62A.

If the user thus pushes the "Printing Allowed" switch, that is, if the user issues the second-pass printing instruction, the CPU 52 receives this instruction from the user (step S14) and checks the presence of the paper sheet 8 with respect to the designated paper feed port 61A (step S15). Thus, the CPU determines whether the paper 8 is present in the MP tray 62A based on the detection results of a paper sensor 63A. Because it is usually supposed to be immediately after the user has completed setting the paper 8 into the MP tray 62A in the initial page of the second pass, the paper sheet 8 is determined to be present (yes in step S15) and the processing makes a transition to step S5.

Figure 4D:
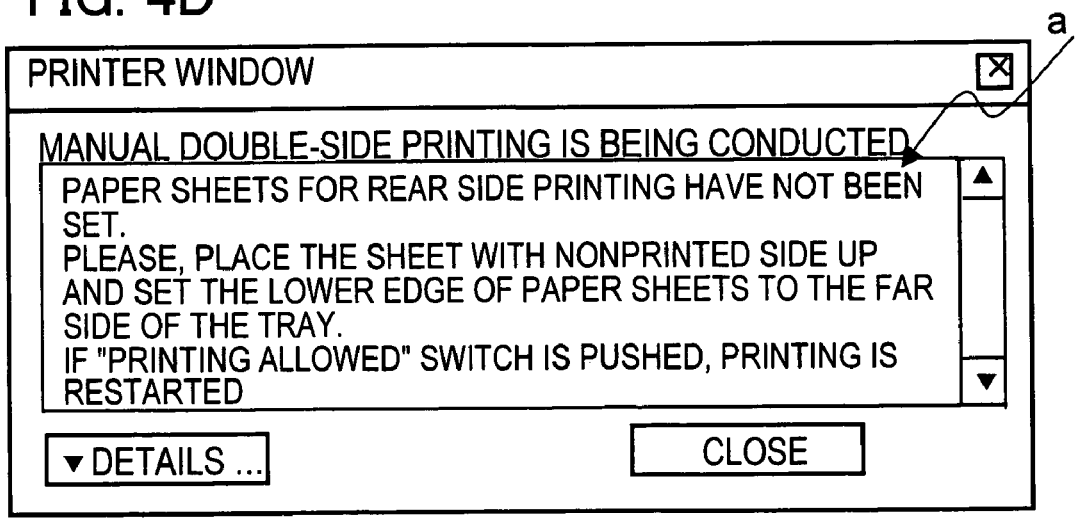

On the other hand, when the paper sheet 8 is determined to be absent (No in step S15), the operation unit 7 is instructed to display a message urging the user to set the paper sheet 8 (step S16). When the messages are displayed on the operation unit 7, the display space is sometimes limited, a message is displayed that is similar to that of step S13 and is shown by way of an example in FIGS. 4A and 4B, and the user is urged to set the paper sheet into the MP tray 62A and push the "Printing Allowed" switch. Furthermore, when the messages are displayed on the host computer 1, the display space is sufficiently large. Therefore, a message expressed in a manner different from of step S13 may be displayed. FIG. 4D shows an example of the displayed message. The expression of the portion (a) in the figure is different from that of step S13 (FIG. 4C).

If the user sets the paper sheet 8 into the MP tray 62A and pushes the "Printing Allowed" switch according to the display of this message, the CPU 52 receives this instruction (step S17) and again checks whether the paper sheet 8 is present (step S15), and if the paper sheet is confirmed to be present (Yes in step S15), the processing moves to step S5. If the paper sheet is absent (No in step S15), the processing is again conducted from the above-described step S16.

After the paper sheet has been confirmed to be present, the engine 6 is instructed to paper feed this page similarly to the first pass (step S5) and the transfer of image data onto this page is started (step S6). Having received the instruction, the engine 6 implements the printing processing on the paper sheet 8 that was set into the MP tray 62A because the MP tray 62A was designated as the paper feed tray (step S8), and then discharges the paper sheet into the paper discharge tray 65. This paper discharge (step S7) completes the processing of this page. In the above-described example of carrying out the manual double-side printing on four pages, the processing of the first page, which is the initial page of the second pass, is thereby completed.

On the other hand, in the case the page is not the initial page of the second pass in the step S11 (No in step S11), the above-described steps S12 to S14 are not carried out, the processing moves to step S15 and then the processing of the contents as described above is conducted. Thus, the user is urged to set the paper sheet to attain a state in which the paper sheet is present in the MP tray 62A, and after the state with the paper sheet present in the tray has been attained, the printing process is conducted from the paper feed instruction (S5) and continuous processing is conducted till the paper is discharged (S7). In the above-described example of carrying out the manual double-side printing on four pages, this processing is carried out with respect to the third page and the printing job of the four pages is thereby completed.

With the processing shown in FIG. 2, when the user was urged to set the paper sheet, the user was also urged to push the "Printing Allowed" switch after setting the paper sheet, and the transition to the subsequent processing was made after confirming that the user performed the operation of pushing the "Printing Allowed" switch, in other words, after receiving the printing instruction from the user. However, the steps of producing this printing instruction from the user and receiving this instruction may be omitted. In the example shown in FIG. 2, steps S14 and S17 may be omitted.

Figure 3:
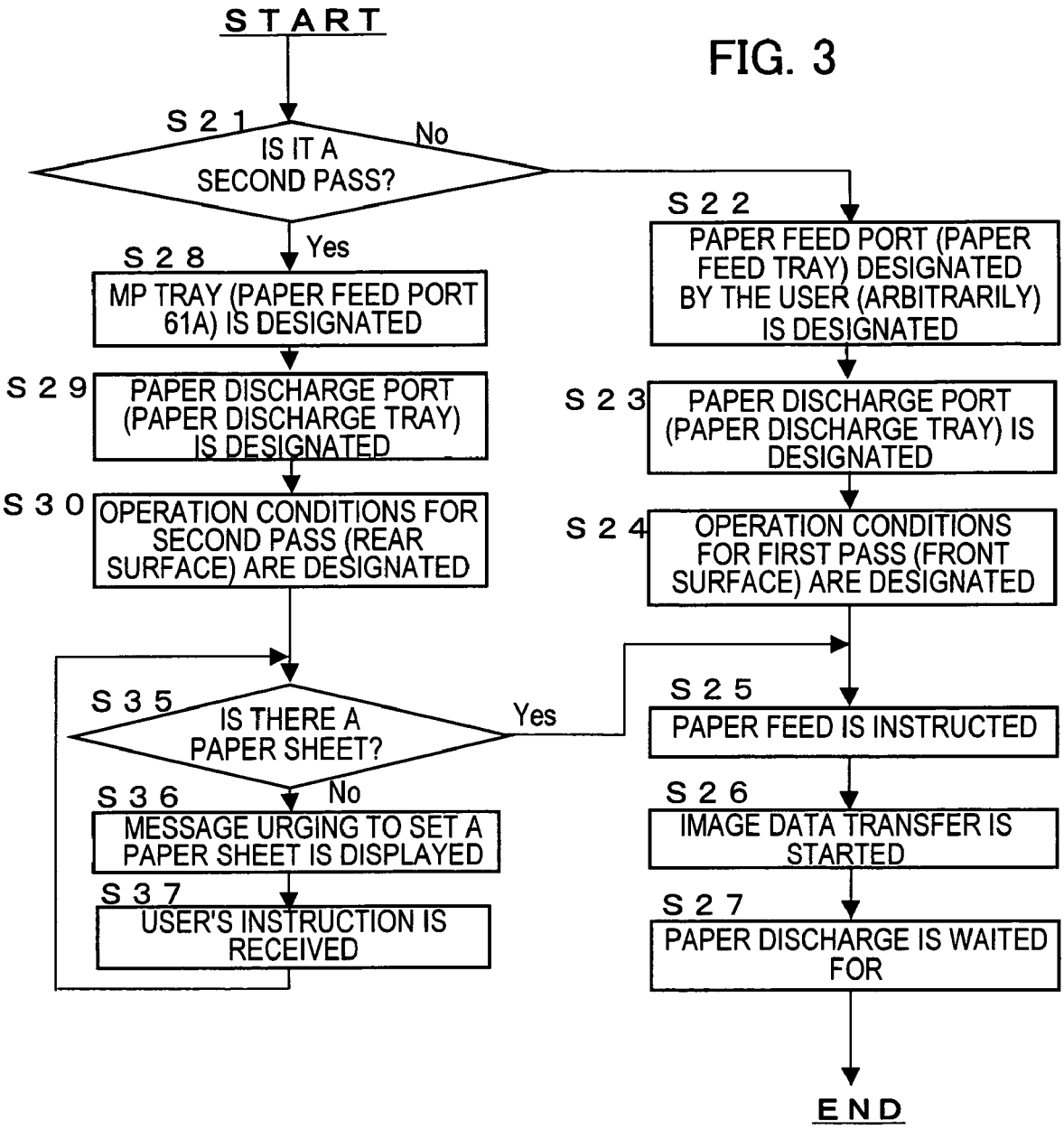
FIG. 3 is another flowchart illustrating the contents of the processing executed by the CPU 52.

Furthermore, in the processing illustrated by FIG. 2, the processing flows were different for the initial page and other pages in the processing of the second pass, but the processing may be also conducted by using the same processing flow. FIG. 3 is a flow chart illustrating the processing flow relating to this case. In the example shown in FIG. 3, steps S21 to S30 correspond to steps S1 to S10 in FIG. 2, and the processing of the first pass and the processing prior to designation of operation conditions of the second pass are the same as in FIG. 2.

Then, in the example shown in FIG. 3, the presence of the paper sheet 8 in the MP tray 62A is verified, regardless of whether or not it is the initial page of the second pass (step S35), and when the paper sheet is absent (No in step S35), the operations of displaying the message urging the user to set the paper sheet (step S36) and receiving the user's instructions (step S37) are repeatedly conducted in the same manner as in steps S16 and S17 shown in FIG. 2, till the state in which the paper sheet is present is attained. If the state in which the paper sheet is present is attained (Yes in step S35), then the processing is conducted from instructing the engine 6 to feed the paper (step S25) in the same manner as in steps after step S5 shown in FIG. 2.

Thus, in the example shown in FIG. 3, if the paper sheet 8 is set in the MP tray 62A that is fixed for the second pass, the printing processing is executed, regardless of whether the page is the initial page of the second path, and if the paper sheet 8 is not set in the MP tray 62A, the user is urged to set the paper sheet 8. In this case, too, the operations of pushing the "Printing Allowed" switch after setting the paper sheet and receiving the user's instruction based thereon may be omitted. Thus, step S37 shown in FIG. 3 may be omitted.

As described hereinabove, in the printer 2 of the present embodiment, a plurality of paper feed units are prepared, but when manual double-side printing is carried out, the paper feed port 61 (paper feed tray 62) of the second pass is fixed to the paper feed port 61A (MP tray 62A). Therefore, if the paper sheet 8 is not present in the paper feed port 61A for the second pass (MP tray 62A), paper feed is not carried out and printing processing is not executed for the second pass of the manual double-side printing. As a result, automatic paper feeding from the paper feed port 61 where other paper sheets 8 are present after the first pass is completed and before the user sets the paper sheet 8 for the second pass and subsequent second-pass printing on the wrong paper sheet 8 can be prevented. Furthermore, even when the paper sheets 8 are consumed in the course of the second-pass printing, for example, in the case where all the paper sheets 8 cannot be set at one time in the MP tray 62A when large-volume manual double-side printing is conducted, automatic paper feeding from the paper feed port 61 where other paper sheets 8 are present and subsequent second-pass printing on the wrong paper sheet 8 prior to replenishing the paper in the correct paper feed port 61A can be prevented. Furthermore, thus preventing paper feed from incorrect paper fed port 61 makes it possible to avoid the paper feed of the type incompatible with the operation conditions and to prevent paper jam.

Furthermore, the present printer 2 is provided with a paper sensor 63A for detecting whether or not the paper sheet 8 is present in the MP tray 62A fixed for the second pass, and when the paper sheet 8 is not present, a message urging the user to set the paper sheet is displayed. Therefore, the processing is prevented from remaining in the interrupted state due to the fact that the paper sheet 8 for the second pass is not fed. Furthermore, the risk of another user setting an incorrect paper sheet 8 into the MP tray 62A and conducting second-pass printing on the incorrect paper sheet 8 before the user of the manual double-side printing sets the correct paper sheet 8 for the second pass is reduced.

Furthermore, in the present embodiment, the printer 2 was described as a four-cycle laser printing, but it can also be the so-called tandem printer or monochromatic printer. Moreover, it may be a printer of another printing system such as an ink-jet printer. Furthermore, in the present embodiment, the so-called host-base system was described, but the present invention can be also employed even without the host-base system. In addition, the present invention is not limited to printers and can be also employed in other image forming devices such as copiers.

The protection scope of the present invention is not limited to the above-described embodiments and covers the inventions described in the claims and equivalents thereof.

What is claimed is:

1. An image forming device for executing manual double-side printing in which a user sets a paper sheet when printing is conducted on the other side of said paper sheet after printing on one side of said paper sheet is completed, comprising:

a plurality of paper feed units which feed said paper sheets;

a control unit which, when the user designates a paper feed unit, instructs a printing unit to feed paper from the user-designated paper feed unit, and which, when the user designates automatic paper feed selection, instructs the printing unit to feed paper from a paper feed unit which matches with a printing job, and which, when printing on the other side of said paper sheet is carried out, instructs the printing unit to feed paper from one of said paper feed units that is preset for printing on said other side; and the printing unit which carries out the paper feed from said preset paper feed unit, according to said paper feed instruction, and executes said printing of the other side on said paper sheet that is fed.

2. The image forming device according to claim 1, further comprising:

a paper sheet presence detection unit which detects the presence of paper sheets in said preset paper feed unit, and a display unit which displays messages for a user of said image forming device, wherein when the printing is conducted on the other side of said paper sheet, in the case where said paper sheet presence detection unit detects the presence of a paper sheet, said control unit issues said paper feed instruction, and in the case where said paper sheet presence detection unit detects that the paper sheet is absent, said control unit instructs said display unit to display a message suggesting to set said paper sheet into said preset paper feed unit.

* * * * *